United States Patent [19]

Nakabayashi et al.

[11] Patent Number: 4,466,199

[45] Date of Patent: Aug. 21, 1984

[54] DEHYDRATION PROCESS FOR ORGANIC SOLID MATERIAL

[75] Inventors: Yasuyuki Nakabayashi, Yokohama; Yoshio Matsuura, Funabashi; Michio Kurihara, Mitaka; Takao Kamei, Ashiya; Akira Nakamura, Akashi; Keiichi Komai, Akashi; Akira Simotamari, Akashi; Izumi Matsuno, Kobe, all of Japan

[73] Assignees: Electric Power Development Co., Ltd.; Kawasaki Jukogyo Kobushiki Kaisha, both of Tokyo, Japan

[21] Appl. No.: 343,772

[22] Filed: Jan. 28, 1982

[51] Int. Cl.[3] ..... F26B 3/00

[52] U.S. Cl. ..... 34/9; 34/15; 34/35; 134/109

[58] Field of Search ..... 34/9, 15, 22, 35, 36; 110/224; 209/236; 134/104, 109; 44/16, 2

[56] References Cited

U.S. PATENT DOCUMENTS 3,007,254 11/1961 Schuster ..... 34/35
3,942,262 3/1976 Perry ..... 34/15
4,209,911 7/1980 Weber ..... 34/9

*Primary Examiner*—Larry I. Schwartz
*Assistant Examiner*—David W. Westphal
*Attorney, Agent, or Firm*—Kerkam, Stowell, Kondracki & Clarke

[57] ABSTRACT

Process for dehydrating water-containing organic solid material which comprises steps of introducing the material into a pressure vessel, applying saturated steam to said vessel to heat the material so that water in the material is removed and mixed with condensate of the steam to be exhausted from the vessel as a waste water. The waste water is transferred to another pressure vessel in which the material is not charged yet, the material being then charged into the vessel to carry out the same dehydrating steps. According to the process, a sufficient amount of heat exchange is performed between the material and the waste water so as to recover the heat in the waste water. Further, the waste water functions as a cushion for the material which is being thrown into the vessel so that the material can be protected from being pulverized.

7 Claims, 1 Drawing Figure

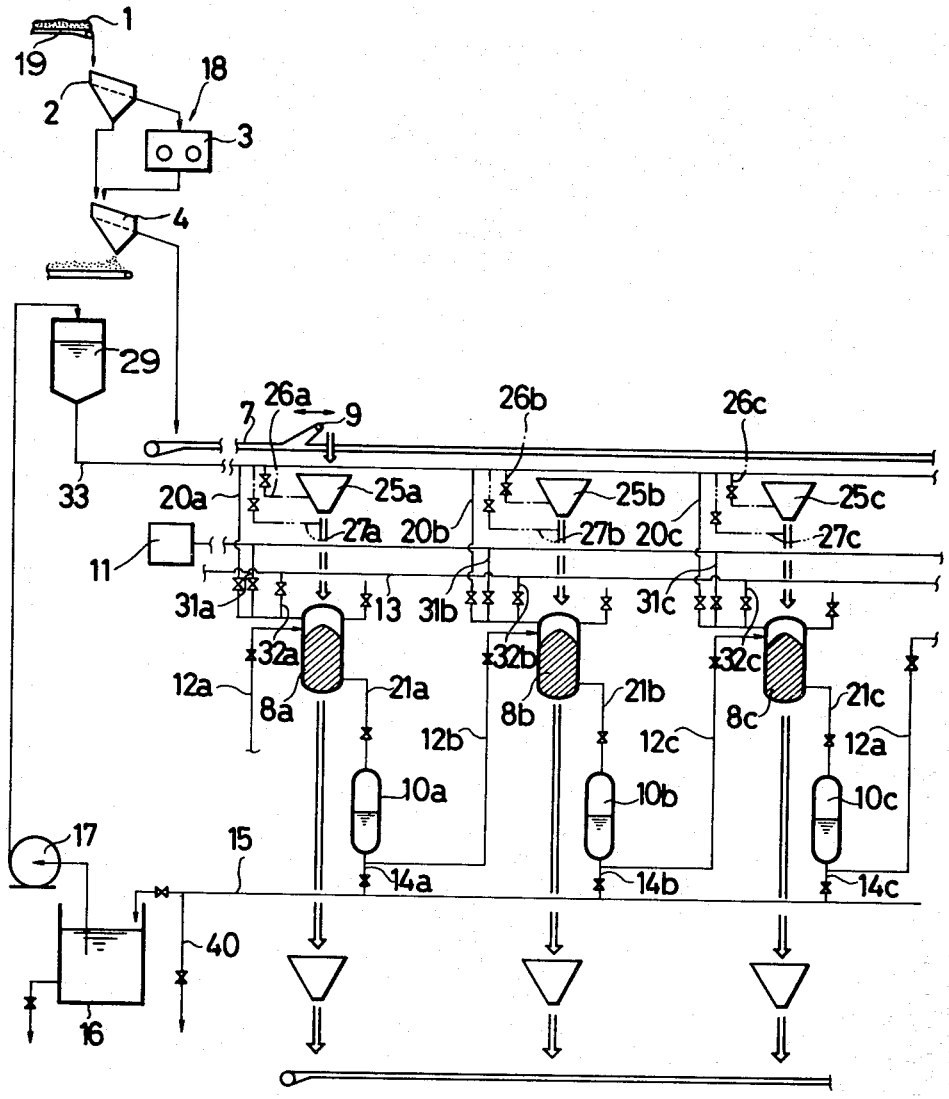
1
19
18
2
3
4
29
26a
9
7
26b
26c
33
20a
25a
25b
25c
27a
20b
27b
20c
27c
11
31a
13
31b
31c
32a
32b
32c
12a
8a
21a
8b
21b
8c
21c
12b
12c
12a
10a
10b
10c
17
15
14a
14b
14c
40
16

DEHYDRATION PROCESS FOR ORGANIC SOLID MATERIAL

The present invention relates to a dehydrating process and more particularly to a process for dehydrating porous organic solid materials such as brown coal which can be dehydrated under an atmosphere in which water cannot be evaporated.

Hithertofore, dehydration of solid material such as brown coal has been carried out by an evaporation process such as a dry air process or an indirect heating process. These processes, however, have disadvantages in that the heat consumption is excessive, that the material has to be crushed in advance and that the dust is produced upon dehydration. Further, fire is likely to occur in the dehydrated material.

In order to eliminate the above disadvantages, a saturated steam dehydration process has been developed. The process utilizes the liquid form dehydration phenomenon in which physical and chemical changes are produced in a porous solid material such as brown coal when it is heated under a non-evaporating atmosphere with the result that water in liquid form is removed from pores in the solid material. In actual practice, the process is carried out by using a plurality of pressure vessels in which batch processes are proceeded with phase differences between the vessels. In one of typical processes, the brown coal to be dehydrated is sieved to remove fine powders and put into the vessels with time differences. Each of the vessels is then closed and supplied with saturated steam to be heated thereby so that water in the coal is removed in liquid form to produce hot water which is a mixture of the water removed from the coal and the condensed steam. The hot water is then introduced into a hot water reservoir. The vessel is thereafter depressurized so that the residual water in the brown coal is further evaporated.

The liquid form dehydrating process is characterized in that lumps of organic solid material of a substantial size can be dehydrated as they are, however, there are problems when it is applied to a dehydration of fine particles because water is constrained in spaces between particles under a capillary action and may be drawn into the material when the vessel is depressurized. Further, the fine particles of the material may be carried by the hot water out of the vessel and may sometimes cause clogging of pipe lines. Thus, in the liquid form dehydrating process, the material is at first sieved as described previously to remove fine particles, however, even after the sieving step, fine particles may be produced when the material is thrown into the vessel.

Further, in the conventional process, there is a further problem in that the heat in the waste water cannot be sufficiently recovered. The hot water as produced in the first vessel in the heating step is at once stored in a reservoir and then introduced into the second vessel which is in a preheating step to apply the heat in the water to the material in the vessel. The steam in the first vessel is also introduced into the third vessel to heat the material therein. The water is introduced into the second vessel flows downward through the layer of the brown coal and a heat exchange is performed between the water and the coal before the water is exhausted from the vessel. In this step, it will be noted that the heat exchange time is insufficient so that the waste water has a substantial residual heat. In the preheating step, however, since the transfer of the heating medium, that is, the hot water and the steam, is carried out under a pressure difference between the pressure vessels, it is impossible to transfer the waste water to a further vessel for recovering the heat therein.

It is therefore an object of the present invention to provide a process for dehydrating porous organic solid material in which heat can be effectively recovered from the waste water.

Another object of the present invention is to provide a dehydrating process in which the material can be protected from being pulverized during introduction into the pressure vessel.

According to the present invention, the above and other objects can be accomplished by a process for dehydrating water-containing organic solid material which comprises steps of introducing the material into a pressure vessel, applying saturated steam to said vessel to heat the material so that water in the material is removed and mixed with condensate of the steam to be exhausted from the vessel as a waste water, said waste water being transferred to a pressure vessel in which the material is not charged yet, the material being then charged into the vessel to carry out the same dehydrating steps. In another mode of the present invention, the material may be introduced into the vessel together with the waste water.

According to the features of the present invention, a sufficient amount of heat exchange is performed between the material and the waste water so as to recover the heat in the waste water. Further, the waste water functions as a cushion for the material which is being thrown into the vessel so that the material can be protected from being pulverized. In a preferable aspect of the present invention, the waste water is introduced into another vessel which is already charged with material and closed to thereby preheat the material therein. Through this preheating process, the temperature of the waste water is decreased to approximately 100° C. so that there will be no substantial heat loss when the waste water is introduced into an open vessel.

The above and other objects and features of the present invention will become apparent from the following descriptions of a preferred embodiment taking reference to the accompanying drawing which fragmentarily shows an example of the system for carrying out the process of the present invention.

Referring to the drawing, the dehydrating system includes a belt conveyor 19 for transferring a brown coal to be dehydrated to a sieving device 18. The sieving device 18 includes a primary sieve 2, a crusher 3 and a secondary sieve 4 and functions to remove fine particles which are unsuitable for the liquid form dehydration. Beneath the sieving device 18, there is provided a belt conveyor 7 which extends above a series of pressure vessels 8*a*, 8*b* and 8*c*. The number of the pressure vessels may of course be determined as desired to properly carry out the dehydrating steps. The conveyor 7 is provided with a series of trippers 9 which distribute the material on the conveyor 7 to the respective ones of the vessels 8*a*, 8*b* and 8*c* at appropriate times. Hoppers 25*a*, 25*b* and 25*c* may be provided between the conveyor 7 and the vessels 8*a*, 8*b* and 8*c*, respectively, for receiving the material from the conveyor 7 and supplying it respectively to the vessels 8*a*, 8*b* and 8*c* at desired times.

Referring specifically to the process carried out in the vessel 8*a*, the vessel which is in advance filled with hot water is at first charged with material to be dehydrated, such as brown coal and then closed and supplied with saturated steam which is passed from an external steam source 11 through a pipe 31*a* to the vessel 8*a*. The vessels 8*a*, 8*b* and 8*c* are connected at the top portions with the steam source 11 through pipes 31*a*, 31*b* and 31*c*. The material is thus heated and water in the material is removed in liquid form. The consumed steam is condensed in this process and mixed with the water from the material. The vessel 8*a* is provided with a water reservoir 10*a* which is connected with the vessel 8*a* through a pipe 21*a*. The hot water in the vessel 8*a* is therefore introduced into the reservoir 10*a*. The vessels 8*b* and 8*c* are also provided with water reservoirs 10*b* and 10*c* which are respectively connected with the vessels 8*b* and 8*c* through pipes 21*b* and 21*c*. After the dehydrating process, the vessel 8*a* is depressurized so that the residual water in the coal is evaporated. Thereafter, the dehydrated coal is taken out of the vessel 8*a*.

The pressure vessels 8*a*, 8*b* and 8*c* are connected with a pipe 13 respectively through pipes 32*a*, 32*b* and 32*c* which may be used when the dehydration in the vessel 8*a* is finished to transfer the steam in the vessel 8*a* to another vessel 8*c* for preheating the material in the vessel 8*c*. The reservoir 10*a* is connected through a pipe 12*b* with the next vessel 8*b*. Similarly, the reservoirs 10*b* and 10*c* are connected through a pipe 12*c* and a pipe (not shown) with the vessel 8*c* and a next vessel (not shown). The hot water in the reservoir 10*a* is therefore transferred through the pipe 12*b* to the vessel 8*b* by opening the valve in the pipe 12*b* when the liquid form dehydration in the vessel 8*a* is finished to thereby preheat the material in the vessel 8*b*. The water flows down the vessel 8*b* and is passed through the pipe 21*b* to the reservoir 10*b*. The reservoirs 10*a*, 10*b* and 10*c* are provided with discharge pipes 14*a*, 14*b* and 14*c*, respectively, which are connected with a pipe 15 opening to a waste water tank 16. The water introduced into the reservoir 10*b* as described above is therefore discharged through the pipes 14*b* and 15 into the tank 16.

The waste water in the tank 16 is drawn by a pump 17 to a head tank 29 which is connected with a pipe 33 which is in turn connected through pipes 20*a*, 20*b* and 20*c* with the vessels 8*a*, 8*b* and 8*c*. The waste water in the head tank 29 is introduced for example into the vessel 8*c* and then the material is thrown into the vessel 8*c* so that the heat in the water is given to the material. The water in the vessel 8*c* functions as a cushion for the material so that material is protected from being pulverized. Thereafter, the water is taken out of the vessel 8*c* into the reservoir 10*c* from which the water is discharged through the pipes 14*c* and 15 and then through a discharge pipe 18. Parallely with the process in the vessel 8*c*, dehydration process is being progressed in the vessel 8*b* in a similar manner as explained with reference to the vessel 8*a*. Thus, hot water is stored in the reservoir 10*b*. The hot water in the reservoir 10*b* is then transferred through the pipe 12*c* to the vessel 8*c* to preheat the material therein. The steam in the vessel 8*b* is also transferred to the vessel in the next stage. Similarly the hydration process is carried out in the vessel 8*c*.

It will thus be understood that according to the process as described above the heat in the waste water can be effectively recovered. Further, the water in the vessel protects the material from being pulverized when it is thrown into the vessel.

The line 33 from the head tank 29 may be connected through pipes 26*a*, 26*b* and 26*c* with the hoppers 25*a*, 25*b* and 25*c*, respectively, and through pipes 27*a*, 27*b* 27*c* with discharge chutes of the hoppers 25*a*, 25*b* and 25*c* so that the material may be thrown into the vessels 8*a*, 8*b* and 8*c* together with the waste water. With this process, it is also possible to protect the material from being pulverized.

As an example, brown coal from Australia is dehydrated in accordance with the process of the present invention. The net brown coal of 1 kg includes 2 kg of water and the liquid form dehydration process under 250° C. and 40 atms of pressure causes a decrease in the water content to 0.6 kg. After depressurization, the water content in 1 kg of net brown coal is 0.25 kg. The steam consumption in a conventional process is 1.05 kg for the net brown coal of 1 kg. Thus, the calculated heat supply is 700 kcal for 1 kg of net brown coal. The waste water before recirculation is 2.8 kg for 1 kg of net brown coal if the amount of dissipated steam is neglected. The heat in the waste water of 100° C. is 280 kcal for 1 kg of brown coal which is approximately 40% of the total heat supply. If the heat in the waste water is recovered so that the temperature is decreased to 50° C., it is possible to attain an improvement thermal efficiency by about 20% so that the steam consumption is decreased to 0.875 kg for 1 kg of net brown coal.

It should of course be noted that the process of the present invention is not limited to an application to a dehydration of brown coal but it may be applied to any porous organic solid material. Thus, it should be understood that the invention is not limited to the details of the examples as described but changes and modifications may be made without departing from the scope of the appended claims.

We claim:

1. Process for dehydrating water-containing organic solid material which comprises the steps of providing a plurality of pressure vessels; performing liquid-form dehydration in at least one of said pressure vessels by putting the material into said one pressure vessel and applying saturated steam to said one vessel to heat the material so that water in the material is removed and mixed with condensate of the steam to be exhausted from said one vessel as waste water; transferring the waste water to a second pressure vessel in which the material is already charged but the saturated steam is not yet supplied to thereby preheat the material in the second vessel by the water; taking out the waste water from the second vessel and transferring it to a third vessel in which the material is not yet charged; charging the material into said third vessel in which the waste water is already charged so that pulverization of the material is prevented by the waste water when the material is charged into the third vessel while performing liquid-form dehydration in said second vessel.

2. Process in accordance with claim 1, in which the waste water is pumped up before the waste water is transferred to said third pressure vessel.

3. Process in accordance with claim 1 in which the waste water is decreased in temperature in said second vessel to approximately 100° C.

4. Process for dehydrating water-containing organic solid material which comprises the steps of providing a plurality of pressure vessels; performing liquid-form dehydration in at least one of said pressure vessels by putting the material into said one pressure vessel and applying saturated steam to said one vessel to heat the material so that the water in the material is removed and mixed with condensate of the steam to be exhausted from said one vessel as waste water; transferring the water to a second vessel in which the materials are already charged but the saturated steam is not yet supplied to thereby preheat the material in the second vessel by the waste water; taking out the waste water from the second vessel and introducing the waste water into a third pressure vessel together with material to be dehydrated so that pulverization of the material is prevented by the waste water when the material is charged into the third vessel.

5. Process in accordance with claim 4, wherein material is introduced into said third vessel together with the waste water by providing a material hopper to which material and waste water are both supplied and which discharges into said third vessel.

6. Process in accordance with claim 5 in which the waste water is pumped up before the waste water is transferred to said material hopper.

7. Process in accordance with claim 4 in which the waste water is decreased in temperature in said second vessel to approximately 100° C.

* * * * *